United States Patent [19]

Clapp

[11] Patent Number: 4,523,198

[45] Date of Patent: Jun. 11, 1985

[54] RADIO FREQUENCY LENS ANTENNA

[75] Inventor: Roger E. Clapp, Cambridge, Mass.

[73] Assignee: The United States of America as represented by the Secretary of the Air Force, Washington, D.C.

[21] Appl. No.: 511,697

[22] Filed: Jul. 7, 1983

[51] Int. Cl.[3] ..... H01Q 19/06

[52] U.S. Cl. ..... 343/754; 343/368

[58] Field of Search ..... 343/754, 777, 909, 368, 343/371, 372

[56] References Cited

U.S. PATENT DOCUMENTS

| | | | |
|---|---|---|---|
| 3,354,461 | 11/1967 | Kelleher | 343/854 |
| 3,392,394 | 7/1968 | Caballero | 343/754 |
| 3,484,784 | 12/1969 | McLeod | 343/5 |
| 3,487,413 | 12/1969 | Shores | 343/754 |
| 3,680,137 | 7/1972 | Wright | 343/754 |
| 3,754,270 | 8/1973 | Thies | 343/754 |
| 3,922,680 | 11/1975 | Alsberg et al. | 343/754 |
| 4,080,605 | 3/1978 | Hilton | 343/854 |
| 4,176,322 | 11/1979 | Kommrusch | 325/369 |
| 4,222,054 | 9/1980 | Capps | 343/754 |
| 4,343,006 | 8/1982 | McVeigh et al. | 343/854 |
| 4,356,462 | 10/1982 | Bowman | 333/128 |

*Primary Examiner*—Eli Lieberman

*Attorney, Agent, or Firm*—Donald J. Singer; Richard J. Donahue

[57] ABSTRACT

Multiple beam antennas are modified and improved through the use of lenses coupled together by hybrid junctions. A dual lens structure avoids circulators while permitting the lenses to be used both for transmission and for reception. A six lens structure provides perfect phase focusing utilizing an R-2R geometry with a Mobius topology, giving 360 degrees of independent antenna beams from a single circular or cylindrical antenna array.

4 Claims, 10 Drawing Figures

FIG. 1
PRIOR ART
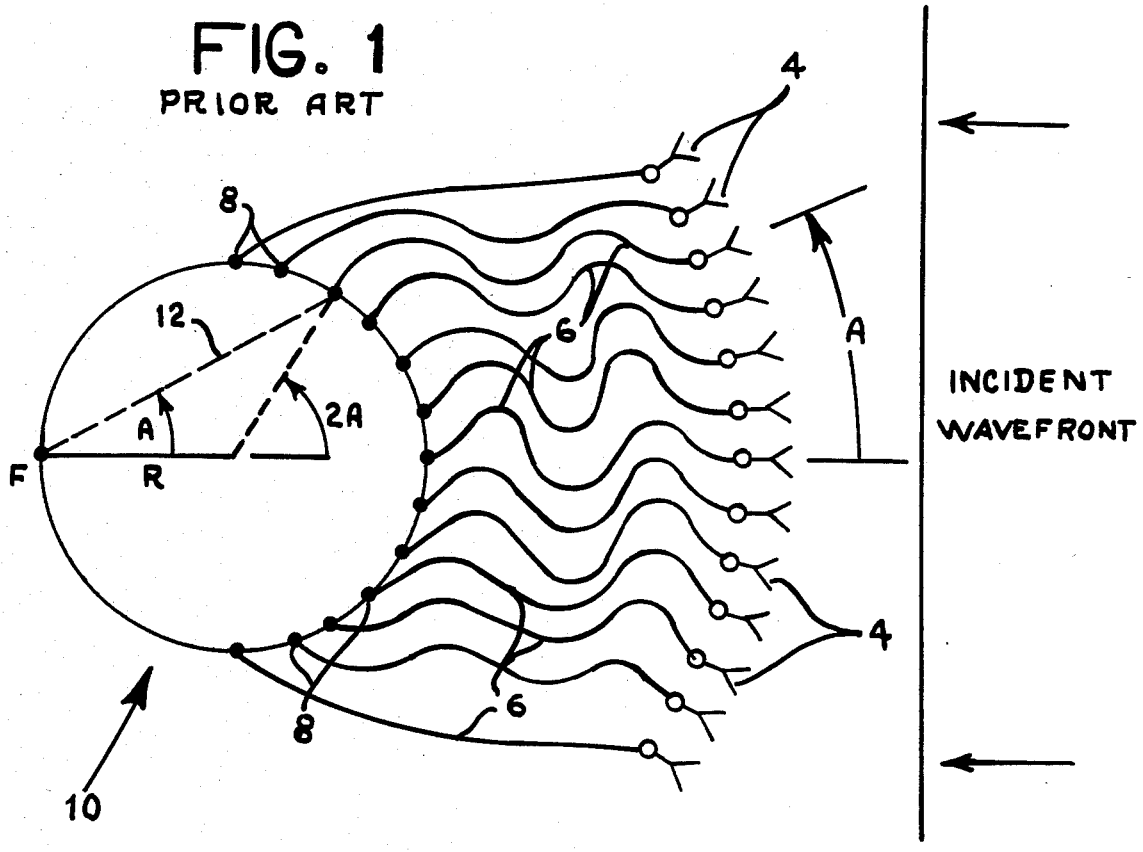
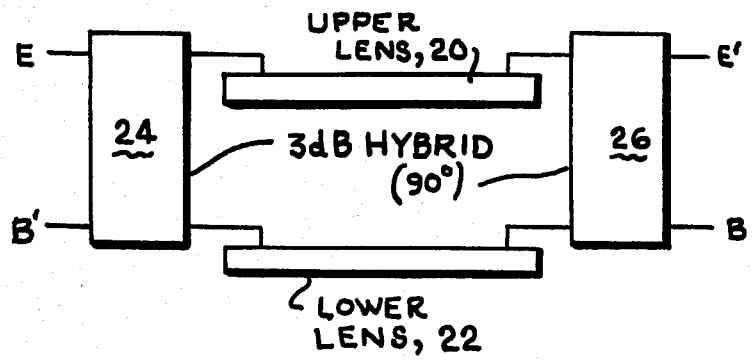
FIG. 2

FIG. 5
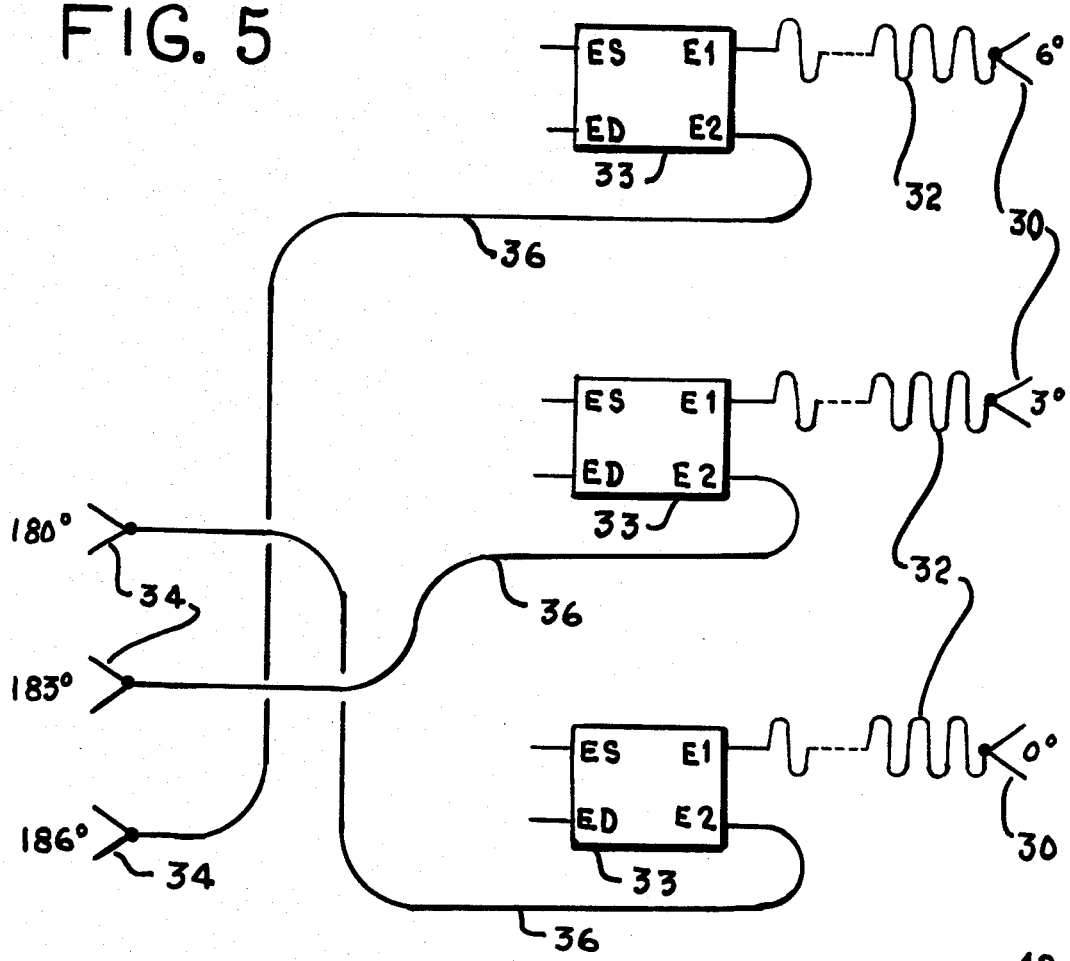
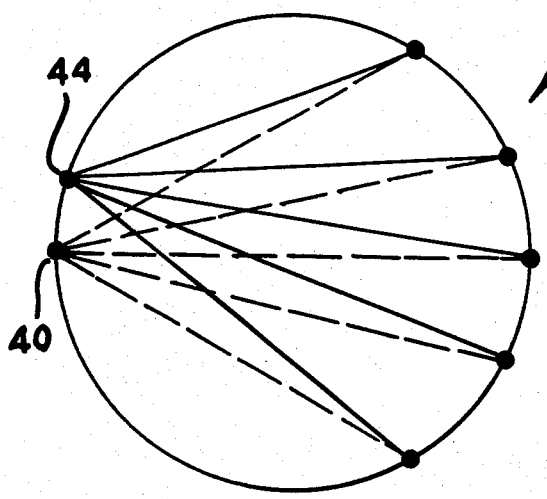
FIG. 6A
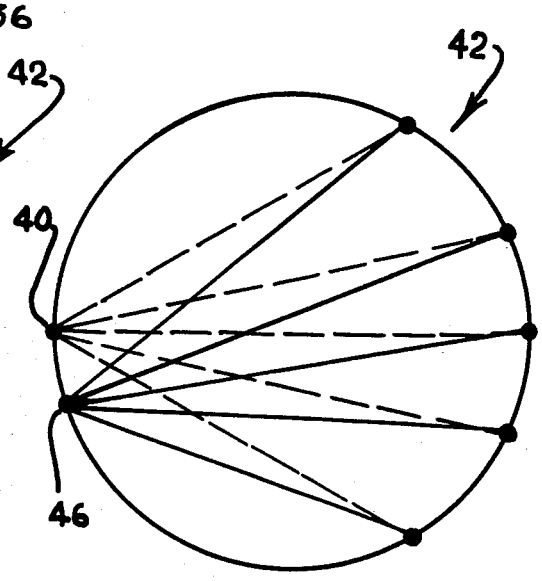
FIG. 6B

FIG. 7
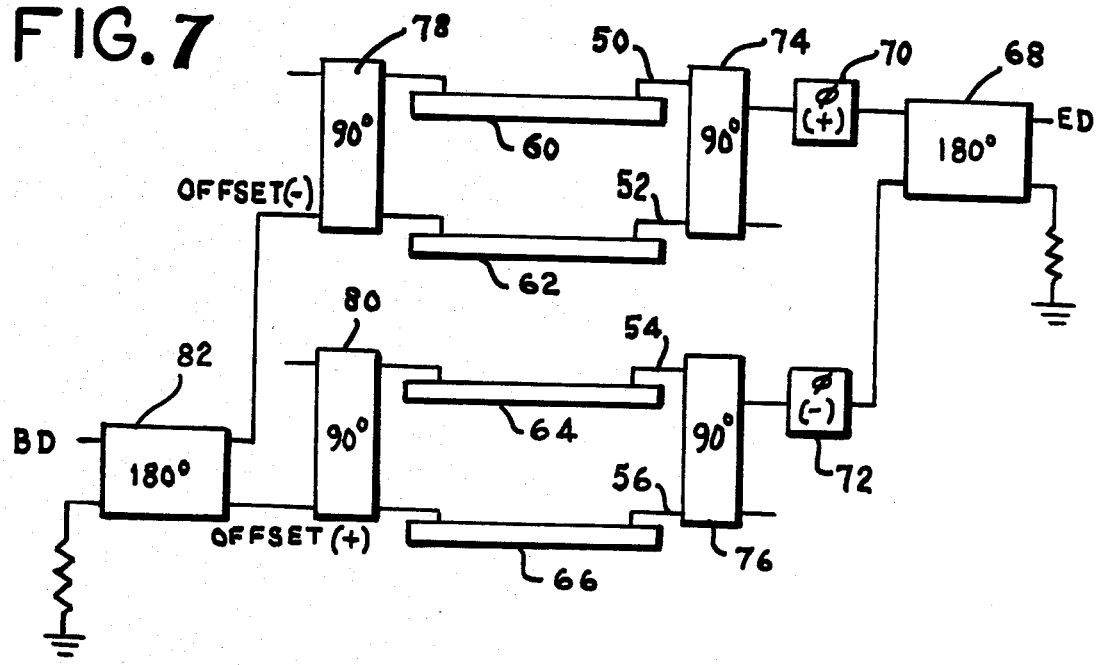
FIG. 8
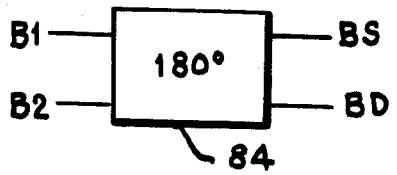
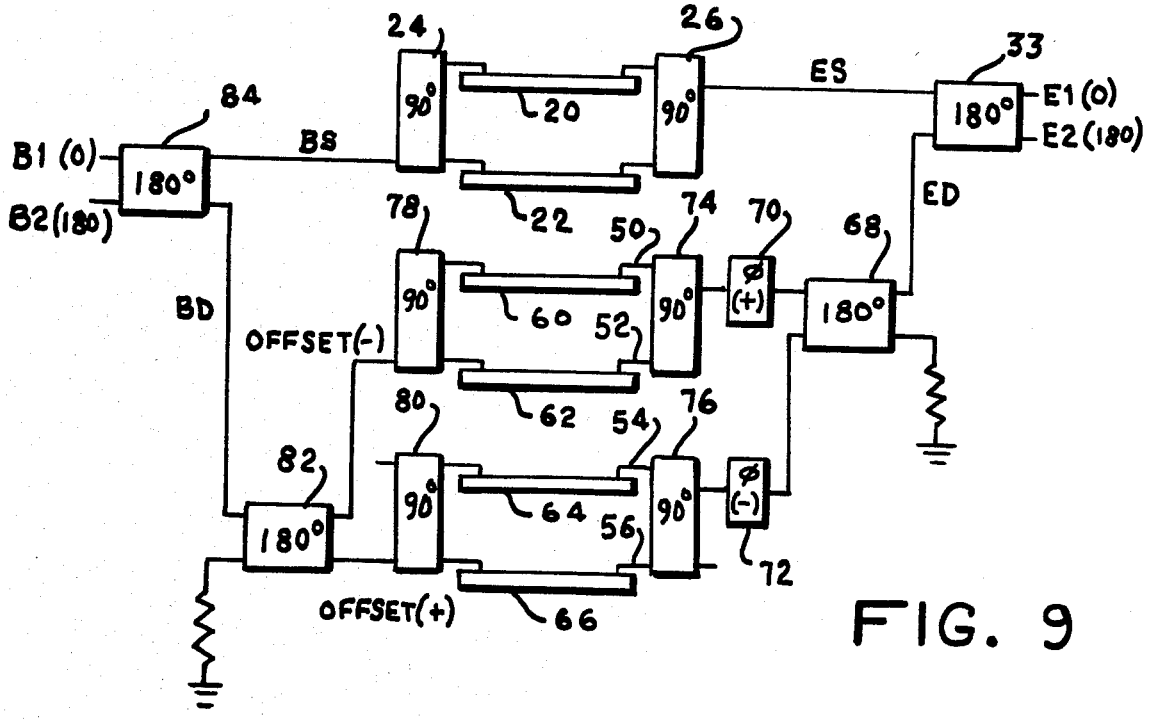
FIG. 9

RADIO FREQUENCY LENS ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to radio frequency antenna arrays and in particular to an improved omnidirectional array utilizing a Mobius topology of R-2R lenses. Many approaches have been used for constructing wide-angle radio frequency antennas having multiple simultaneous beams. These approaches include the Luneburg lens, in which a dielectric medium with a graded dielectric constant is used to focus an incident plane wave, arriving at one side of the lens structure, to a point focus on the other side of the lens structure. The dielectric lens may have the shape of a full sphere, or a hemisphere over a conducting ground plane. Alternatively, the graded dielectric may be confined between parallel conducting surfaces, and in this case the focusing is two-dimensional rather than three-dimensional. A geodesic version of the Luneburg lens has also been described in the literature. For the geodesic version, focusing is two-dimensional, but this focusing results not from a graded dielectric constant but from the shaping of a pair of parallel conducting surfaces to make the propagating rays in the space between the surfaces come to the same kind of focus that would result from the use of a graded dielectric constant between flat conducting surfaces.

The R-KR lens is another lens design that has been used for the generation of multiple simultaneous beams from a curved aperture. In this design there is a one-to-one mapping from the array elements to the lens periphery, so that a complete circle of array elements can be mapped directly onto a single circuit of the periphery of a circular lens. However, with an R-KR lens the lens geometry does not ordinarily provide precise focusing. The resulting phase errors can lead to antenna sidelobes whose magnitude may be unacceptable high, for certain applications.

For perfect focusing, the signal received at each array element, from a distant source or radar target, will enter the lens, cross the lens to the focal point, and arrive in exact phase with the signals received at all of the other array elements that participate in the beam directed at that source or target. Imperfect focusing results when there are phase errors that keep the different signal rays from arriving in phase with each other. Phase errors that arise out of the lens geometry are collectively denoted by the term "coma aberration". The phase errors comprising the coma aberration will ordinarily vary slowly from one array element to the next, so that these errors can be expressed as a smooth function of a variable locating the elements on the circular or cylindrical array. In particular, the coma aberration can be written as a power series, a polynomial function of the angular variable A, where this angle locates a radiating element on the curved aperture. If this angle is measured from the boresight direction (the direction toward which this antenna beam is focused), then symmetry ensures that the polynomial will contain only even powers of the angle A. The R-KR lens is designed to be corrected through the squared term in this polynomial, but not through the higher terms (fourth and sixth powers, etc.).

The R-2R lens, on the other hand, provides exact phase correction, through all terms in the error polynomial. When a plane wave is incident on array elements 4 arranged on a circular arc, as shown in FIG. 1, the extra propagation distance for a ray that reaches an element at the angle A, as compared with the central ray (A=0), is given by:

$$f(A)=2R[1-\cos A] \quad (1)$$

where 2R is defined as the radius of the circular arc. These array elements are connected (by equal line lengths 6) to lens couplers 8 on the periphery of a parallel-plate lens 10 whose radius is R, half the radius of the antenna array. Furthermore, the element at the angle A is connected to a coupler whose angular position on the lens is 2A, as shown in FIG. 1. It can be seen that the propagation distance across the lens is equal to:

$$g(A)=2R\cos A \quad (2)$$

where this propagation is along a chord 12 to the focal point at the left-hand edge of the lens.

When the two segments of the propagation path are added together, the result is:

$$f(A)+g(A)=2R \quad (3)$$

which is a constant, independent of the angle A which specifies the ray that is being considered. Thus all of the rays in the incident plane wave, within the region intercepted by the cylindrical antenna, will come to a common focus at the edge of the lens.

This precise focusing, together with the intrinsic simplicity of the R-2R lens, has made this lens design an attractive choice, when coverage of only a limited angular sector is desired. As is evident from FIG. 1, when an attempt is made to enlarge the cylindrical arc to 180 degrees or beyond, the doubled angle at the lens periphery extends to 360 degrees and beyond, which is not feasible with the simple arrangement of FIG. 1, since there are only 360 degrees in a full circle and once this amount of lens periphery has been utilized there is no more remaining. Even the approach toward 180 degrees of cylindrical arc (resulting in an approach toward 360 degrees of utilized lens periphery) has the effect of narrowing the portion of the lens periphery available for separate beam ports.

The allocation of a particular coupling structure to be either a beam port or an element port has this effect: as the portion of the lens periphery connected to array elements is increased, the portion available for beam ports is reduced. This limitation can be avoided, if desired, through the use of circulators, circuit elements which separate out the signals passing in opposite directions along a transmission line. The use of circulators will make possible the employment of the same coupling structures for both beam ports and element ports. However, circulators are nonreciprocal structures, and when nonreciprocal components such as circulators are used in the design of a lens antenna, it is ordinarily not possible to use the same lens antenna for both transmission and reception. This is a limitation which could be important in certain applications of multibeam antennas, particularly in the use of these antennas at nodes of survivable communications networks.

SUMMARY OF THE INVENTION

It is an object of the present invention, therefore, to provide a lens antenna for simultaneous use in transmission and reception of radio frequency signals which does not require nonreciprocal components.

It is a further object of the present invention to provide an improved radio frequency antenna array capable of precise focusing through 360 degrees of arc, and capable of use for both transmission and reception.

Briefly, a fresh look was taken at the R-2R lens with the results that are described herein. In the reconsideration of the R-2R lens, it was found that the "serious limitation" on the angular coverage could be avoided through the use of a topological scheme, a scheme which involves an analogy with a "Mobius strip". The resulting Mobius R-2R lens retains the precise focusing of the R-2R geometry while avoiding the topological limitation that restricts the applicability of the conventional R-2R lens.

The present invention addresses the limitations of lens antennas, and undertakes to remove those limitations in order to increase the usefulness of radio frequency lens concepts.

Two generalizing modifications of radio frequency lenses, utilizing hybrid junctions, are disclosed herein. One modification makes use of a dual-lens structure, with 3dB hybrids that provide for the (passive and reciprocal) separation of beam ports and element ports, even when both kinds of ports are located at the same position around the lens periphery. A second modification gives the lens a Mobius topology, in which two distinguishable circuits of the lens periphery can be mapped onto separate 180 degree sectors of a cylindrical antenna array.

BRIEF DESCRIPTION OF THE DRAWINGS

FIG. 1 is a pictorial representation of a prior art R-2R lens antenna array;

FIG. 2 is a block diagram of a dual lens structure in accordance with the present invention;

FIG. 5 is a block diagram representation of the interconnections of array elements and hybrid junctions in the present invention;

FIG. 6A is a diagram of clockwise focal point displacement resulting from a lagging progressive phase;

FIG. 6B is a diagram of counterclockwise focal point displacement resulting from leading progressive phase;

FIG. 7 is a diagram of the lens structure for focusing element-difference signals onto beam-difference ports;

FIG. 8 is a block diagram of a 180 degree hybrid junction utilized in the present invention; and FIG. 9 is a block diagram depicting signal flow in the present invention.

DESCRIPTION OF THE PREFERRED EMBODIMENTS

Dual-Lens Structure

Figure 3:
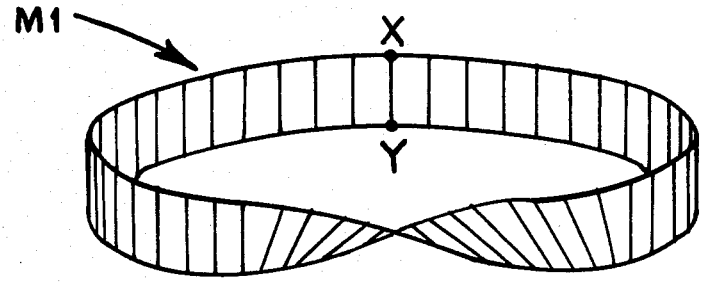
FIG. 3 is a pictorial representation of a Mobius strip.

With a circular lens such as the R-2R lens, or the R-KR lens which is also a well-known configuration, the couplers (or launchers) around the lens periphery will in some locations be connected to antenna array elements, while in other locations the couplers serve as focal points and are connected to the individual beam ports. With the use of a circulator, a particular coupler can be connected to an array element, thus serving as an element port for the lens, and can at the same time be connected to a transmitter or receiver, thus serving as a beam port for the lens. If the antenna is to be dedicated to transmission, then the circulator should be connected in such a way that power flows from the transmitter to the lens, and from the lens to the array element. If the antenna is to be dedicated to reception, then the connections to the circulator should be reversed, so that power flows from the array element to the lens and from the lens to the receiver. In this way a particular lens coupler can be used both as an element port and as a beam port, provided the lens antenna is dedicated to transmission, or to reception, but not to both at once. This is a limitation that follows from the nonreciprocal character of the circulator.

The generalization to a dual-lens structure removes this limitation and permits an antenna to be used for transmission and reception, both at the same time. As shown in FIG. 2, two identical lenses 20 and 22 are employed, with matching coupler locations connected together using 3dB hybrids, such as hybrids 24 and 26.

On reception, a signal reaching an antenna array element will be carried to an element port, labeled E in FIG. 2. Passing through the 3dB hybrid 24 to the launching structures, this signal will enter both lenses. The signal enters the upper lens 20 directly; it also enters the lower lens 22, but with phase lag of 90 degrees, relative to its phase on entering the upper lens 20. These two versions of the same received signal then cross the two lenses to the launching structures on the other side. Here they pass into the 3dB hybrids that are arranged around that side of the pair of lenses. In each hybrid, the arriving signals are identical, top and bottom, except for the 90 degree phase shift that was introduced by the input connection at the left of the FIG. This phase shift is just enough to channel the signals to the lower output of the hybrid, the output labeled B on the right-hand side of FIG. 2. The label B designates a beam port.

A similar process takes place when the lens antenna is used for transmission. A signal to be sent is fed to one of the beam ports, such as the beam port B′ at the left-hand side of FIG. 2. Here the signal enters a 3dB hybrid, such as hybrid 24 which splits the power in half. One half of the signal power is fed directly to the lower lens 22, through a launching structure, and the other half is fed to the upper lens after a phase lag of 90 degrees. These two versions of the signal cross the two lenses to the opposite side, where they are distributed over two sets of output launch structures, one set on the periphery of the upper lens 20, the other set on the periphery of the lower lens 22. At a particular location around the two lenses, there will be a pair of corresponding launch structures, one above the other, feeding corresponding signals to a hybrid junction which sums them after inserting internal phase shifts of 90 degrees. These internal phase shifts, when combined with the 90 degree phase offset already present in the signals (introduced by the connections at the energizing beam port), cause the two signals to reinforce at the upper output of the hybrid, labeled E′ at the right-hand side of FIG. 2, and to cancel at the lower output, labeled B.

Since the two lenses are identical by design, whatever propagation there is in one lens is duplicated in the other. (This feature is essential for the proper functioning of the dual-lens structure). Thus the distribution of signal energy from one beam port to the antenna array elements, and the focusing of energy received by the antenna array elements onto a particular beam port, will both take place according to the optical characteristics within each lens. The use of the dual-lens structure, with the 3dB hybrids around the periphery connecting matching launchers, serves to separate the element ports from the beam ports, while retaining unaltered the focusing properties o the individual lenses.

The 3dB hybrids are less expensive than the circulators used in the single-lens concepts discussed earlier. Furthermore, the 3dB hybrids are linear, reciprocal elements, and function independently of the direction of power flow between beam ports and element ports. It is this characteristic, distinguishing the 3dB hybrids from the nonreciprocal circulators, that permits the dual-lens structure to be used both for transmission and for reception.

While circulators are not used within the lens structure, there is a possible role for circulators in separating a transmitted signal entering a beam port from a received signal emerging from that beam port. This use of circulators could be of particular value when a multiple-beam antenna is employed as a node in a communications network.

Mobius Topology

A Mobius strip M1 is illustrated in FIG. 3. As can be seen, this is a figure with only one surface and only one edge. In particular, if we start at a point X on the upper edge, then follow the edge around, one circuit around the structure moves us to a corresponding point Y on the lower edge. If we continue following the edge, the next circuit around the structure carries us back to the upper point X. Since the motion has never left the edge, and has passed through every point contained in the upper and lower edge regions, it is clear that there is really only one edge, but that it takes two circuits of the structure to pass through all points of this edge.

Figure 4:
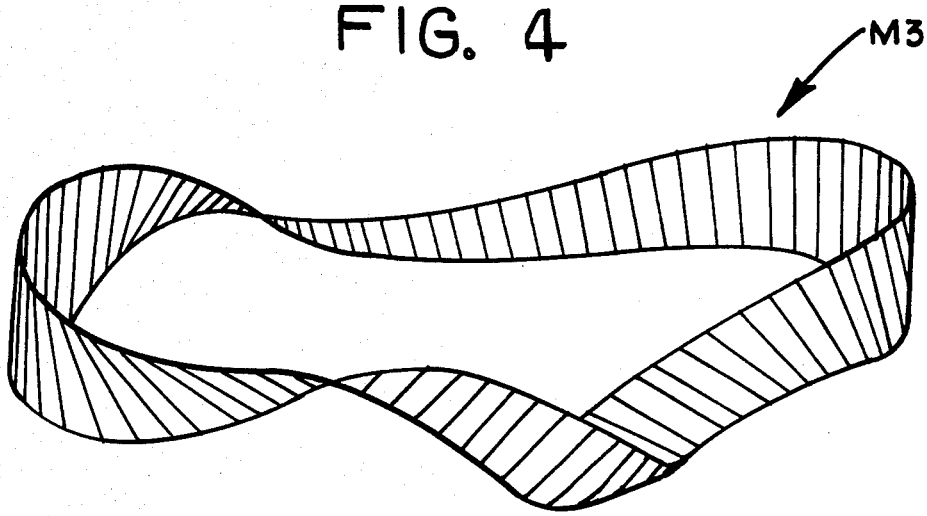
FIG. 4 is a pictorial representation of a Mobius strip having three half twists.

Additional half-twists can be inserted. Adding an odd number of half-twists, so that the total number of half-twists is even, destroys the Mobius character of the structure. Alternatively, adding to the first half-twist an even number of additional half-twists, so that the total number remains odd, leaves the Mobius character unaffected. For example, FIG. 4 shows a strip M3 which rejoins itself after three half-twists; this is a generalized Mobius strip, which, like that in FIG. 3, has only one surface and only one edge.

In both of these illustrations, two circuits of the structure are required before all edge points have been touched. This characteristic is what is needed for an R-2R lens antenna, if this antenna is to have 360 degree coverage. That is, one circuit of the cylindrical antenna array needs to be mapped onto two distinguishable circuits of the parallel-plate lens. The angular doubling (an angle on the array mapping onto a doubled angle on the lens periphery) is needed to maintain the optical correction. This requires that the lens be circled twice while the array is circled only once. The Mobius topology is just what is needed, and would seem to be clearly dicatated by the mapping requirements.

Mobius Lens

The actual implementation of the Mobius topology, in a parallel-plate lens structure, can be carried out through the aid of progressive phasing, and an increase in the number of physical lenses to be incorporated into the structure. Whereas the generalization to a dual-lens structure involved the replacement of a single lens by two physical lenses, coupled together by 3dB hybrids, the generalization to a Mobius lens structure will involve the replacement of the original R-2R lens by a set of six physical lenses, coupled together by hybrids and power dividers. In this replacement, the dual-lens function, permitting antenna use for transmission and reception at the same time, is incorporated. Also, the perfect phase correction, characteristic of the R-2R lens, will be maintained, at the same time that the lens structure is being generalized to give full 360 degree coverage.

It should be noted that the "perfect phase correction" refers to the geometrical-optics coma correction. In the design of a lens structure to feed a cylindrical or circular antenna array, it is necessary to make allowance for the phase dependence of the antenna pattern for each array element in the presence of the other elements. It is also necessary to make allowance for the phase dependence of the launcher patterns inside the parallel-plate lenses. In addition, an extra phase dependence may be incorporated as part of the illumination function across the radiating aperture, if this extra phase dependence is found desirable for maintaining low sidelobes. All of these phase factors are separate from the coma correction, and are not being considered in the present analysis. They could, however, be handled through the use of a dielectric correction plate to be inserted into each of the physical lenses. The design of dielectric plates for circularly-symmetric parallel-plate lenses has been discussed by B. Rulf in the paper entitled "A Two Dimensional Lens for Multibeam Antennas", p. 140–143 of the 1982 APS Symposium Digest, IEEE Antennas and Propagation Society Publication 82CH1783-0, 1982.

The Mobius lens structure will be described in stages, moving from the array elements, through the physical lenses, to the beam ports. In the first of these stages, the array elements are connected to hybrid "magic tees", which are 3dB hybrids with internal phase shifts of 0 degrees and 180 degrees. The connections are here to be made in such a way that the output signals represent sums and differences of the signals received on diametrically opposite antenna array elements.

The connection scheme is illustrated in FIG. 5, for a cylindrical antenna array having 120 array elements, spaced at 3 degrees. The array elements 30 located at 0, 3, 6, . . . , 177 degrees are connected by equal-length coaxial lines 32 to the upper inputs, designated E1, of a ring of hybrids 33. The array elements 34 located at 180, 183, 186, . . . , 357 degrees are connected by equal-length coaxial lines 36 to the lower inputs, designated E2, of this same ring of hybrids. The connections are stepped cyclically, so that the first of these hybrids has the element sum (ES) and element difference (ED) outputs given by $$ES(0)=E1(0)+E2(180) \quad (4a)$$

$$ED(0)=E1(0)-E2(180) \quad (4b)$$

while the second hybrid has outputs $$ES(3)=E1(3)+E2(183) \quad (5a)$$

$$ED(3)=E1(3)-E2(183) \quad (5b)$$

and so forth, through $$ES(177)=E1(177)+E2(357) \quad (6a)$$

$$ED(177)=E1(177)-E2(357) \quad (6b)$$

Element-Sum Focusing

The ring of upper outputs, the set of element-sum outputs ES, is already in an appropriate form to constitute a set of input signals for an R-2R lens having a full 360 degree coverage. That is, these outputs ES can form the inputs to an R-2R lens such as that shown in FIG. 1. If, further, we incorporate the dual-lens concept of FIG. 2, using 90 degree 3dB hybrids, then we will have beam outputs which are isolated from the element inputs. These beam outputs will actually be beam-sum outputs, each of them being a summation of two beams pointing in diametrically opposite directions. Accordingly, the beam-sum output for the direction angle A will be designated as BS(A), which will be a sum of two beams:

$$BS(A)=B1(A)+B2(A+180) \quad (7)$$

In equations (4–7), and in equation (8), below, a normalizing factor, equal to the square root of one-half, would ordinarily multiply the right-hand side. This factor has been absorbed into the definitions of the quantities ES, ED, BS and BD, to simplify the equations.

Element-Difference Focusing

Considering now the ring of lower outputs in FIG. 5, the difference outputs ED, it is necessary to construct a focusing geometry which takes the signals ED as inputs and generates beam-difference outputs BD, such that $$BD(A)=B1(A)-B2(A+180) \quad (8)$$

Once these beam-difference signals BD have been generated, they can be combined in 180 degree 3dB hybrids (magic tees) to separate and isolate the individual beam signals B1 and B2, the beam-port signals for a pair of beams pointed in diametrically opposite directions. This combination is carried out for each pair of opposite directions, and the result is that individual beam signals have been constructed, for each beam in a full circle of beams.

The construction of a focusing geometry for the sum signals was simplified by the lack of any discontinuity in the ring of element-sum signals, at the angle A=180. The sequence of signals ES, starting with ES(0) in equation (4a) and ending with ES(177) in equation (6a), would logically be followed by ES(180), defined by $$ES(180)=E1(180)+E2(360), \quad (9a)$$

but this can be seen to be equivalent to ES(0) as defined in equation (4a), since each is the sum of an element signal for the array element at 0 degrees and an element signal for the array element at 180 degrees. Thus the fact that the R-2R focusing geometry maps 180 degrees of antenna array onto 360 degrees of lens periphery does not introduce any difficulty here, since the element-sum signals repeat themselves after every 180 degrees of array periphery, and join smoothly everywhere.

The situation is more complicated, when constructing an R-2R focusing geometry for the difference signals. The difficulty is evident when comparing ED(0) in equation (4b) with the combination ED(180) obtainable through moving one step past ED(177) in equation (6b). This next step would give $$ED(180)=E1(180)-E2(360) \quad (9b)$$

which is not equivalent to ED(0) but to its negative. Thus if we were to use the element-difference signals ED, directly, as inputs to an R-2R lens, we would be introducing a strong discontinuity at A=180.

This discontinuity can be removed through the following procedure. Before connecting the element-difference signals ED to the periphery of an R-2R lens, a phase shift is introduced which is different for each connecting line, and which is progressive around the lens periphery, accumulating to 180 degrees of phase as the full ring of connections is made. That is, ED(0) is connected directly to the appropriate launcher on the lens periphery, but 3 degrees of phase shift is inserted in the line that connects ED(3) to the next launcher on the lens, and 6 degrees of phase shift in the line that connects ED(6) to the lens, and so forth. As we approach ED(177), a larger and larger phase shift will be inserted, which reaches 177 degrees when we reach the connection from ED(177) to its appropriate launcher on the lens periphery.

Now when we consider moving on to the logically next element-difference signal, ED(180) as given in equation (9b), the connection would accordingly include an inserted phase shift of 180 degrees, which is equivalent to multiplication by a factor of minus one. It is evident, from a comparison of equation (9b) with equation (4b), that this factor of minus one is just what is needed to transform ED(180) into ED(0). That is, the progressive phase shift has accumulated just enough to provide for a phase reversal that compensates for the intrinsic phase reversal in ED(180) relative to ED(0).

The sequence of element-difference signals ED has an intrinsic Mobius topology, when mapped onto an R-2R lens periphery. One full circuit of the R-2R lens carries ED(0) into ED(180) which is the reverse of ED(0). Inserting the progressive phase shift provides for an accumulation of 180 degrees of phase during this same full circuit of the R-2R lens, and the cumulative 180 degree phase shift just compensates for the Mobius phase reversal, producing continuity across the boundary location.

It is evident that the continuity will result if the inserted phase shifts are phase lags, but it will also result if the inserted phase shifts are all phase leads. In either case, the increment of 3 degrees per launcher location will accumulate to give the needed phase reversal after one full circuit of the R-2R lens. The phase reversal can be a phase shift of +180 degrees, or a phase shift of −180 degrees. Furthermore, an incremental phase shift of 9 degrees per launcher location will also serve the desired purpose, since an accumulation of +540 degrees or −540 degrees is once again equivalent to a multiplication by a factor of minus one. If we consider the incremental phase shifts as similar to small geometrical twists, then we can see that the increments of 3 degrees lead to an accumulated half-twist as shown in FIG. 3, while the increments of 9 degrees lead to an accumulation of three half-twists over the lens circuit, as illustrated by the generalized Mobius strip in FIG. 4.

Offset Focal Points

The introduction of a progressive phase shift around an R-2R lens alters the focusing characteristics of the lens. Instead of coming to a precise focal point, directly opposite to the center of the effective receiving aperture (as mapped onto the lens periphery), the rays which cross the interior of the lens will come to an approximate focal point which is offset in one direction or the other, with the direction of offset depending upon whether the progressive phase shift is a lag or a lead. The approximate focal point is still on the lens periphery, but displaced around this periphery by a small distance.

The displacement is by an electrical distance equal to one radian (about one-sixth wavelength), if the progressive phase shift is such as to give a cumulative 180 degrees for a full circuit around the lens periphery, and if the focusing is optimized for the central rays within the family of rays crossing the lens. On the other hand, if the progressive phase shift is tripled, so that the cumulative phase shift comes to 540 degrees instead of 180 degrees, then the offset distance for the approximate focal point is three radians (about one-half wavelength). This latter choice is somewhat more convenient in practice, since it corresponds more closely to the spacing of launcher structures ordinarily needed in such a lens.

Furthermore, in practice an electrical length somewhat greater than one radian (or three radians) may be desirable as the offset distance. This optimizes the focusing for rays somewhat to either side of the central rays in the focused ray family.

In any case, we need to consider that the displaced focal point is not in itself a perfect focus. The progressive phase is proportional to the angular position of a ray within the family, while the compensating phase shift, due to the shortening or lengthening of the ray within the lens (associated with the displacement of the focal point), is proportional to the sine of the angle locating that ray. For small angles, the sine of an angle is approximately equal to that angle in radian measure, but for larger angles the difference between an angle and its sine becomes important.

The geometry is shown in FIGS. 6A and 6B. The focal point 40 at the left-hand side of the R-2R lens 42 is displaced upward to point 44 for the case in which the progressive phase shift is an accumulating phase lag; this case is illustrated in FIG. 6A. When the phase increments are phase leads, the result is the downward displacement of the focal point to point 46, as shown in FIG. 6B.

If either one of these cases is chosen for the element-difference focusing, the result will be an imperfect focus. However, if both cases are chosen and the resulting beam signals added together, the result will be a phase-perfect focus, since the residual phase errors associated with the two cases are in the opposite direction and add to zero. The next residual error that remains is not an error in phasing, but a modification in amplitude. In fact, this modification is just equivalent to an amplitude taper across the radiative aperture. Since an amplitude taper is desirable, and the launcher structures within the lens will be designed to incorporate an amplitude taper, any additional amplitude taper can in principle be absorbed into a small readjustment of the launcher directivity pattern.

To utilize this compensatory focusing, the element-difference signals ED need first to be fed to power dividers which generate two identical versions, each with half of the ED power. One of these two versions is used for inputting to an R-2R lens incorporating progressive lagging phases, while the other version is used for inputting to an R-2R lens incorporating progressive leading phases around the lens periphery. Each of these R-2R lenses should actually be a dual-lens structure with 90 degree 3dB couplers, as illustrated in FIG. 2, so that the beam outputs are isolated from the element inputs. The offset focal points are then recognized and incorporated through a simple procedure. The two launcher locations that are to be combined to give a beam-difference signal are chosen to have displacements in opposite directions. A beam-port location which is displaced clockwise is taken from the phase-lag dual-lens structure, and a beam-port location which is displaced counterclockwise is taken from the phase-lead dual-lens structure. The signals from these two beam-port outputs are added together in a power combiner, and this summation signal is then the desired beam-difference signal, the BD signal in equation (8).

The power combiner will in practice be a 180 degree hybrid junction whose sum output is the desired BD signal. The difference output will contain the phase-error components in the separate outputs from the two R-2R lenses which are being used together, and this unwanted output should be fed to a matched load.

The resulting lens structure for handling the element-difference signals ED and generating the beam-difference signals BD is indicated in FIG. 7. What is shown is the division of the input signals ED into four branches 50, 52, 54 and 56 which traverse the four separate physical lens structures 60, 62, 64 and 66 respectively in which the focusing takes place. The separate branches 50, 52, 54 and 56 are formed by coupling each of the element-difference signals ED through a 180 degree hybrid junction, such as hybrid junction 68, whose outputs are applied to appropriate valued phase shifters, such as phase shifters 70 and 72. Their outputs, in turn, are applied to 90 degree hybrid junctions 74 and 76. The outputs of these four separate physical lenses are reassembled in hybrid junctions such as hybrid junction 78, 80 and 82 in such a way that the beam-difference signals BD retain the perfect phase-focusing of the R-2R geometry.

Individual Antenna Beams

The separate physical lenses have been operating on the sums and differences of the signals received on diametrically opposite array elements, and the outputs have led to the beam-sum and beam-difference signals BS and BD. These can now be combined in 180 degree 3dB hybrids 84, as shown in FIG. 8, to give the individual beam-port signals which are the final outputs of the multiple-beam lens structure. The signal flow through the full system of six physical lenses is indicated in FIG. 9.

In the example which has been used, with 120 array elements spaced at 3 degree around a full circle or cylinder, there will be an equal number, 120, of individual antenna beams, available for simultaneous use. Furthermore, each beam can be used for transmission as well as for reception, though the discussion herein has mainly been phrased in terms of a receiving system. Because of the dual-lens configuration (which appears three times over in this system concept), and because of the use of linear, reciprocal elements throughout, each beam port can be connected either to a receiving circuit or to a transmitting circuit, or switched between such circuits according to the operational requirements which the multiple-beam antenna structure is to satisfy.

The choice of the particular number, 120, has been made for illustrative purposes only. The concept is not dependent on this number, and any even number of array elements can be chosen, leading to an equal number of individual antenna beams.

The perfect phase-focusing of the R-2R lens has been limited in the past by restrictions on the angular sector that could be covered by this lens. The two-to-one angular expansion involved in mapping array elements onto launchers on the lens periphery served as an inherent limitation.

The introduction of a Mobius mapping avoids this limitation through a topological device. The array elements contained in 360 degrees of array periphery are mapped onto 720 degrees of lens periphery, through the utilization of hybrid junctions and multiple lenses. At the same time, a dual-lens concept is incorporated which provides for a clear separation of beam ports and element ports without the use of circulators, and as a consequence allows the lens structure to be used both for reception and for transmission.

While circulators are not needed for the separation of beam ports from element ports, there could be a role for circulators in providing for the external connections to the beam ports. That is, the use of a circulator at a beam port would make it possible for the transmitter and receiver for a particular antenna beam to be simultaneously connected to the same beam port. This would permit two-way communications over a single beam without the use of any switches.

With the use of six physical lenses, the dual-lens concept and the Mobius mapping are both implemented, while retaining the perfect phase-focusing contained in the R-2R lens geometry. While there are six physical lenses, which introduces complexity, each lens is relatively small, only half the diameter of the antenna array if the lens interior is air, still smaller if the lens interior is a dielectric.

While there are many hybrid junctions needed to implement this Mobius lens concept, the junction types are very few, and a production design could use printed-circuit techniques to assemble large numbers of hybrid junctions onto extended strips of dielectric substrate.

In summary, the proposed Mobius R-2R lens, feeding a circular or cylindrical antenna array, could have application whenever multiple simultaneous antenna beams are desired, with a full 360 degree coverage.

Although the invention has been described with reference to particular embodiments thereof, it will be understood to those skilled in the art that the invention is capable of a variety of alternative embodiments within the spirit and scope of the appended claims.

What is claimed is:

1. An R-2R lens antenna system comprising:

first, second and third lens assemblies, each of said lens assemblies comprising a pair of R-2R lenses each having N signal transfer ports, where N is a number, disposed about the circular periphery thereof, each of said lens assemblies further comprising N ninety degree hybrid couplers each having an element signal port, a beam signal port, and a pair of phase-related signal ports, said phase-related signal ports being connected to like-positioned signal transfer ports in said pair of R-2R lenses, a plurality of antenna elements arranged in a circular array, first coupler means for combining diametrically-opposed pairs of said antenna elements to form element sum and element difference signals, means for coupling said element sum signals to element signal ports of said first lens assembly, phase shift means for receiving said element difference signals to form phase leading and phase lagging element difference signals, said phase shift means providing a progressively incremented value of phase shift for element difference signals derived from progressively arranged pairs of said antenna elements, means for coupling said phase leading element difference signals to the element signal port of said second lens assembly, means for coupling said phase lagging element difference signals to the element signal port of said third lens assembly, second coupler means coupled to the beam signal ports of said second and said third lens assembly to provide a composite beam difference signal, and third coupler means coupled to the beam signal port of said first lens assembly and receiving the composite beam difference signal from said second coupler means to provide beam signals for diametrically-opposed beam directions.

2. Apparatus as defined in claim 1 wherein said first, second and third coupler means each comprise a 180 degree hybrid junction.

3. Apparatus as defined in claim 2 wherein said array comprises 120 antenna elements and said incremented value of phase shift is 3 degrees.

4. Apparatus as defined in claim 2 wherein said array comprises 120 antenna elements and said incremented value of phase shift is 9 degrees.

* * * * *

UNITED STATES PATENT AND TRADEMARK OFFICE

CERTIFICATE OF CORRECTION

PATENT NO. : 4,523,198

DATED : 11 June 1985

INVENTOR(S) : Roger E. Clapp

It is certified that error appears in the above-identified patent and that said Letters Patent are hereby corrected as shown below:

In the following equations, a space should be provided between the equation and its numerical designation, as follows:

Column 2, line 11 should read

-- $f(A)=2R[1 - \cos A]$ (1) --

Column 2, line 21 should read

-- $g(A)=2R \cos A$ (2) --

Column 2, line 27 should read

-- $f(A)+g(A)=2R$ (3) --

Column 6, line 56 should read

-- $ES(0)=E1(0)+E2(180)$ (4a) --

Column 6, line 58 should read

-- $ED(0)=E1(0)-E2(180)$ (4b) --

Column 6, line 61 should read

-- $ES(3)=E1(3)+E2(183)$ (5a) --

Column 6, line 63 should read

-- $ED(3)=E1(3)-E2(183)$ (5b) --

Column 6, line 66 should read

-- $ES(177)=E1(177)+E2(357)$ (6a) --

UNITED STATES PATENT AND TRADEMARK OFFICE

CERTIFICATE OF CORRECTION

PATENT NO. : 4,523,198

DATED : 11 June 1985

INVENTOR(S) : Roger E. Clapp

It is certified that error appears in the above-identified patent and that said Letters Patent are hereby corrected as shown below:

Column 6, line 68 should read

-- ED(177)=E1(177)-E2(357) (6b) --

Column 7, line 18 should read

-- BS(A)=B1(A)+B2(A+180) (7) --

Column 7, line 34 should read

-- BD(A)=B1(A)-B2(A+180) (8) --

Column 7, line 51 should read

-- ES(180)=E1(180)+E2(360), (9a) --

Column 7, line 69 should read

-- ED(180)=E1(180)-E2(360) (9b) --

Signed and Sealed this

*Eighth* Day of *October 1985*

[SEAL]

*Attest:*

*Attesting Officer*

DONALD J. QUIGG

*Commissioner of Patents and Trademarks—Designate*